US006688143B2

(12) United States Patent
Williams

(10) Patent No.: US 6,688,143 B2
(45) Date of Patent: Feb. 10, 2004

(54) ELASTOMERIC KNIT FABRIC WITH ANTIFLAME PROPERTIES

(75) Inventor: Jan L. Williams, Greenville, SC (US)

(73) Assignee: Milliken & Company, Spartanburg, SC (US)

( * ) Notice: Subject to any disclaimer, the term of this patent is extended or adjusted under 35 U.S.C. 154(b) by 162 days.

(21) Appl. No.: 10/010,346

(22) Filed: Dec. 5, 2001

(65) Prior Publication Data

US 2003/0101777 A1 Jun. 5, 2003

(51) Int. Cl.[7] ..... D04B 21/16
(52) U.S. Cl. ..... 66/195; 442/310; 66/202
(58) Field of Search ..... 66/202, 195, 190, 66/193; 442/307, 304, 312, 310

(56) References Cited

U.S. PATENT DOCUMENTS 3,468,843 A * 9/1969 Busse ..... 524/403
3,666,713 A * 5/1972 Wear ..... 524/114
4,064,298 A * 12/1977 Schwartz et al. ..... 428/95
4,101,528 A * 7/1978 Knopka ..... 524/409
4,377,195 A * 3/1983 Weil ..... 66/195
4,425,397 A * 1/1984 George ..... 442/68
4,688,403 A * 8/1987 Gajjar ..... 66/195
5,985,961 A * 11/1999 Dailey et al. ..... 524/100

OTHER PUBLICATIONS

International Search Report PCT/US02/37055 filed Nov. 20, 2002 for "Elastomeric Knit with Antiflame Properties".

* cited by examiner

*Primary Examiner*—Danny Worrell
(74) *Attorney, Agent, or Firm*—Terry T. Moyer; John E. Vick, Jr.

(57) ABSTRACT

A warp knit fabric having elastomeric yarns and polyester yarns, the polyester yarns including a flame retardant agent incorporated therein.

14 Claims, 1 Drawing Sheet

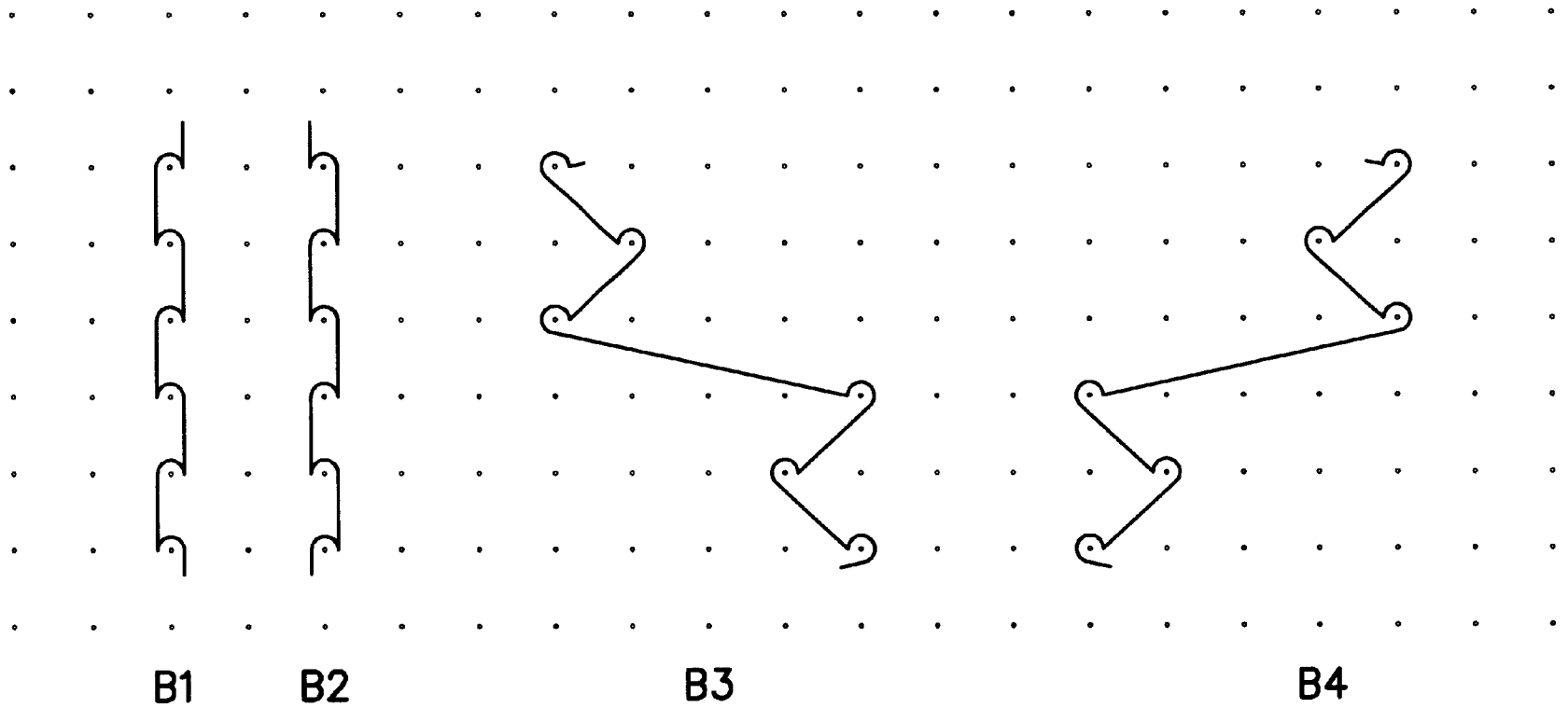
FIG. —1—

ELASTOMERIC KNIT FABRIC WITH ANTIFLAME PROPERTIES

BACKGROUND

Elastomeric knit fabrics are knit fabrics that contain elastomeric properties. The elastomeric properties can result from both the structure of the knit and the components, such as the use of elastomeric yarns. Elastomeric knits can be used in a wide array of applications. For example, elastomeric knits can be used for seating applications. However, fabrics for seating applications have certain criteria, such as resistance to burning. In particular, automotive seating applications have stringent anti-flammability requirements. Therefore, there is a need for elastomeric knit fabrics that have anti-flammability properties.

BRIEF DESCRIPTION OF THE DRAWINGS

FIG. 1 is a diagram illustrating a knitting pattern on a four bar raschel knitting machine for one embodiment of the present invention.

DETAILED DESCRIPTION

The present invention generally comprises a knit fabric having a combination of elastomeric and non-elastomeric yarns, with the non-elastomeric polymeric yarns including a flame retardant agent.

Elastomeric yarns, as used herein, means a nontextured yarn that can be stretched at room temperature to at least seventy-five percent over its original length and which after removal of the tensile force will immediately and forcibly return to within ten percent of its original length. To determine if a yarn is elastomeric, ASTM Standard Test Method for Permanent Deformation of Elastomeric Yarns (D 3106-95a), which is incorporated herein in its entirety by specific reference thereto, can be used with the exception that the specimen is stretched to a length of 75% over the original length of the specimen for all stretching time periods, and the elongation after stretch is determined after the longer relaxation time period.

Examples of elastomeric yarn are yarns formed of phthalate-based polyesters used to provide the stabilized monofilaments are linear and cyclic polyalkylene terephthalates, particularly polyethylene terephthalate (PET) polypropylene terephthalate (PPT) polybutylene terephthalate (PBT), ethylene-1,4-cyclohexylenedimethylene terephthalate (PETG), and random or block copolymers thereof contain one or more of the above components. Examples of elastomeric yarn that can be used in the present invention are described in U.S. Pat. No. 5,985,961, entitled Monofilament, and issued to Dailey et al. on Nov. 16, 1999, which is hereby incorporated herein in its entirety by specific reference thereto. The elastomeric yarn in the present invention can be a monofilament or a multifilament, and have a size from about 80 denier to about 6000 denier per filament. The elastomeric yarn in the present invention can also be a core/sheath type yarn.

The elastomeric yarn can be colored in the process of forming the yarn, such as solution dying, causing the colorant material to be distributed evenly throughout the cross section of the yarn. The elastomeric yarn can also be dyed after the formation of the yarn, or after the formation of the fabric, in a yarn dye or piece dye process. In one embodiment, the elastomeric yarn can also include a flame retardant agent similar to the flame retardant agent in the non-elastomeric polymeric yarns. The elastomeric yarn can also include a ultra-violet (UV) inhibitor. Examples of UV inhibitors includes benzotriziazole derivatives, benzotriazine derivatives, benzoxazinones derivatives, benzophenones derivatives, benzoates derivatives, hindered amines, or the like.

The non-elastomeric polymeric yarns of the present invention can include polyester yarns, nylon yarns, acrylic yarns, blends thereof, or the like. The non-elastomeric polymeric yarns can be monofilament, multifilament, staple, textured, or the like. The non-elastomeric polymeric yarn can be colored in the process of forming the yarn, such as solution dying, causing the colorant material to be distributed evenly throughout the cross section of the yarn. The non-elastomeric polymeric yarn can also be dyed after the formation of the yarn or the fabric. The non-elastomeric polymer yarn can also include a ultra-violet (UV) inhibitor similar to the UV inhibitors described in association with the elastomeric yarn.

As previously indicated, in the present invention the non-elastomeric polymeric yarns include a flame retardant agent incorporated into the material of the non-elastomeric polymeric yarns. Examples of flame retardant agents that can be used in the present invention include phosphorous compounds, halogen compounds (such as bromine and chlorine compounds), or the like. The flame retardant agents can be added in the rate of from about 1 to about 30 parts by weight per 100 parts total weight of the non-elastomeric polymeric yarns.

The elastomeric yarn and the non-elastomeric yarn are combined into a warp knit material. The warp knit can be a tricot or raschel knit. The elastomeric fabric can also be heat-set to provide stability and reduce curling of the fabric. The elastomeric fabric is heat-set by heating the knitted fabric to temperature sufficient to align the polymers of the yarns prior to crystallization. In most polymeric yarns, the heat set temperature will be between 220° F. and 400° F.

A knitted elastomeric fabric of the present invention provides good flame retardant properties that can meet the requirements of DOT 571.302 Standard No. 302; Flammability of Interior Materials (Oct. 1, 1996 Edition), hereby incorporated herein in its entirety by specific reference thereto. The knitted elastomeric fabric of the present invention demonstrates a burn rate of 4 inches per minute or less when tested according to this standard. It is believed that the flame retardant properties of the present invention exist because the elastomeric yarn naturally has a tendency to withdraw from a flame before igniting, and the non-elastomeric polymeric yarn is given the opportunity to withdraw from the flame before igniting due to the flame retardant agents incorporated therein.

In one embodiment, the elastomeric knit contains elastomeric yarns combined with polyester non-elastomeric polymer yarns into a raschel knit that has a weight per square area of from about 14 oz/yd$^2$ to about 16 oz/yd$^2$. The fabric is knitted on a raschel knit four-bar knitting machine as illustrated FIG. 1, wherein the first bar (B1) and the second bar (B2) are the non-elastomeric polymeric yarns, and the third bar (B3) and the fourth bar (B4) are the elastomeric yarns. The elastomeric yarns are 800 denier monofilament yarns of elastomeric copolyester polymer material, such as the ELAS-TER® yarns from Teijin of Spartanburg, S.C. The nonelastomeric polymeric yarns are 2/150/34 solution dyed textured polyester yarns that include a flame retardant agent from Omara, Inc. The knitted elastomeric fabric was heat set at 380° F. This elastomeric knit fabirc demonstrated a burn rate of about 0 inches per minute, when measured according to DOT 571.302 Standard No. 302; Flammability of Interior Materials. The fabric also self extinguished in less than 60 seconds and before traveling 2 inches in length.

What is claimed is:

1. A device comprising a knit fabric formed of synthetic non-cellulosic materials, said knit fabric having:

(a) synthetic non-cellulosic elastomeric yarns and (b) synthetic non-cellulosic non-elastomeric polymeric yarns combined into a warp knit material, wherein the synthetic non-cellulosic non-elastomeric polymeric yarns include a flame retardant agent incorporated therein.

2. The device according to claim 1, wherein the non-elastomeric polymeric yarns include polyester.

3. The device according to claim 1, wherein the knit fabric is a raschel knit fabric.

4. The device according to claim 1, wherein the knit fabric is a tricot knit fabric.

5. The device according to claim 1, wherein the elastomeric yarn includes a flame retardant agent.

6. The device according to claim 1, wherein the knit fabric is heat set.

7. The device according to claim 1, wherein the non-elastomeric polymeric yarn is a textured yarn.

8. The device according to claim 1, wherein the elastomeric yarns include a UV inhibitor.

9. The device according to claim 1, wherein the non-elastomeric polymeric yarns include a UV inhibitor.

10. The device according to claim 1, wherein the non-elastomeric polymeric yarn comprises a staple yarn.

11. The device according to claim 1, wherein the non-elastomeric polymeric yarn comprises a multifilament yarn.

12. The device according to claim 1, wherein the non-elastomeric polymeric yarn comprises a monofilament yarn.

13. The device according to claim 1, wherein the non-elastomeric polymeric yarn comprises a solution dyed yarn.

14. The device according to claim 1, wherein the elastomeric yarn comprises a solution yarn.

* * * * *